US010018135B2

(12) United States Patent
Oh et al.

(10) Patent No.: US 10,018,135 B2
(45) Date of Patent: Jul. 10, 2018

(54) METHOD FOR CONTROLLING ENGINE RPM

(71) Applicant: Hyundai Motor Company, Seoul (KR)

(72) Inventors: Wan Soo Oh, Yongin-si (KR); Heung Seok Lee, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 157 days.

(21) Appl. No.: 15/168,743

(22) Filed: May 31, 2016

(65) Prior Publication Data

US 2017/0114742 A1 Apr. 27, 2017

(30) Foreign Application Priority Data

Oct. 21, 2015 (KR) ..... 10-2015-0146380

(51) Int. Cl.

| | |
|---|---|
| ***F02D 41/16*** | (2006.01) |
| ***F02D 41/08*** | (2006.01) |
| ***F02D 41/14*** | (2006.01) |
| ***F02D 41/30*** | (2006.01) |
| ***F02D 31/00*** | (2006.01) |
| *F02D 41/28* | (2006.01) |

(52) U.S. Cl.

CPC ..... *F02D 41/08* (2013.01); *F02D 31/008* (2013.01); *F02D 41/1498* (2013.01); *F02D 41/16* (2013.01); *F02D 41/3005* (2013.01); *F02D 2041/1409* (2013.01); *F02D 2041/1432* (2013.01); *F02D 2041/288* (2013.01); *F02D 2200/101* (2013.01)

(58) Field of Classification Search

CPC .... F02D 31/008; F02D 41/1498; F02D 41/16; F02D 41/08; F02D 2041/288

USPC ..... 701/104, 111; 123/339.19, 339.2, 436

See application file for complete search history.

(56) References Cited

U.S. PATENT DOCUMENTS 4,688,535 A 8/1987 Küttner et al.
5,487,008 A * 1/1996 Ribbens ..... F02D 41/1498 701/102

(Continued)

FOREIGN PATENT DOCUMENTS

JP 2621084 4/1997
JP H10-0682 1/1998

(Continued)

*Primary Examiner* — Erick Solis

(74) *Attorney, Agent, or Firm* — Brinks Gilson & Lione

(57) ABSTRACT

A method for controlling engine revolution per minute (RPM) includes: a frequency deriving process for deriving a frequency from change in engine RPM detected by a detector by a controller during driving of the engine; a frequency conversion process for converting a derivation frequency derived in the frequency deriving process into a conversion frequency via a predetermined conversion process by the controller; a frequency comparison process for comparing an amplitude of the conversion frequency at which engine RPM is to be changed among conversion frequencies converted in the frequency conversion process with an amplitude of a reference frequency pre-inputted to the controller; and a fuel injection amount adjusting process for deriving a correction value based on a result derived in the frequency comparison process, for applying the derived correction value, and for controlling an injector by the controller to adjust a fuel injection amount.

17 Claims, 3 Drawing Sheets

(56) References Cited

U.S. PATENT DOCUMENTS

| | | | | |
|---|---|---|---|---|
| 7,219,003 | B2 * | 5/2007 | Hagel | F02D 41/1498 123/436 |
| 7,430,483 | B2 * | 9/2008 | Wiig | G01H 1/003 701/100 |
| 8,200,415 | B2 * | 6/2012 | Hagel | F02D 41/0087 123/435 |
| 8,494,757 | B2 * | 7/2013 | Haskara | F02D 35/023 123/435 |
| 2007/0163547 | A1 * | 7/2007 | Nakasaka | F02D 13/0207 123/478 |
| 2013/0151122 | A1 * | 6/2013 | Jin | F02D 41/1498 701/104 |
| 2015/0149063 | A1 * | 5/2015 | Shah | F02D 41/0085 701/104 |

FOREIGN PATENT DOCUMENTS

| | | | |
|---|---|---|---|
| JP | H11-44229 | A | 2/1999 |
| JP | 2000-233668 | A | 8/2000 |
| JP | 2012-091751 | A | 5/2012 |
| KR | 10-2011-0046056 | | 5/2011 |

* cited by examiner

METHOD FOR CONTROLLING ENGINE RPM

CROSS REFERENCE TO RELATED APPLICATION

This application claims priority to and the benefit of Korean Patent Application No. 10-2015-0146380, filed on Oct. 21, 2015, which is hereby incorporated by reference in its entirety.

FIELD

The present disclosure relates to a method for controlling engine revolution per minute (RPM), for removing a vicious cycle in which excited vibration during engine driving continues without attenuation.

BACKGROUND

The statements in this section merely provide background information related to the present disclosure and may not constitute prior art.

In general, a complete car company determines a target engine revolution per minute (RPM) during idling through a plurality of vehicle tests, and an engine controlling apparatus performs an operation for maintaining a target engine RPM via an idle controller, ignition, and fuel control.

That is, vibration is generated and controlled during driving of an engine in such a manner that a controller controls a fuel injection rate such that the generated vibration converges on a target RPM that is pre-input to the controller. We have discovered, however, that in certain cases, when a drive system resonance frequency and an idle fuel amount control period are coupled, vibration becomes serious rather than being removed.

In particular, such vibration becomes more serious at a cold time and accordingly, this gives displeasure to users due to noise, vibration, and so on to make consumer dissatisfaction.

SUMMARY

The present disclosure provides a method for controlling engine revolution per minute (RPM), for removing excited components generated during driving of an engine to improve consumer satisfaction by inhibiting or reducing noise and vibration.

According to an exemplary form of the present disclosure, there is provided a method for controlling engine revolution per minute (RPM). The method includes: a frequency deriving process for deriving a frequency from change in engine RPM detected by a detector by a controller during driving of the engine; a frequency conversion process for converting a derivation frequency derived in the frequency deriving process into a conversion frequency via a predetermined conversion process by the controller; a frequency comparison process for comparing amplitude of the conversion frequency at which engine RPM is to be changed among conversion frequencies converted in the frequency conversion process with an amplitude of a reference frequency pre-inputted to the controller; and a fuel injection amount adjusting process for deriving a correction value based on a result derived in the frequency comparison process, applying the derived correction value, and controlling an injector by the controller to adjust a fuel injection amount.

The frequency conversion process may include converting the derivation frequency into the conversion frequency using Fourier Transform.

The frequency conversion process may be applied in an idle state of the engine.

The method may further include a data applying process for applying a state data frequency of the vehicle, which is inputted to the controller, in the frequency comparison process.

The frequency comparison process may include comparing amplitude of the conversion frequency at which engine RPM is to be changed among conversion frequencies to which the state data frequency is applied with amplitude of the reference frequency.

The method may further include a wave removing process for removing a wave of the conversion frequency using a filter by the controller upon checking that amplitude of the conversion frequency is greater than that of the reference frequency in the frequency comparison process.

The wave removing process may include removing the wave of the conversion frequency using a short time mean value filter.

The method may further include a correction value deriving process for deriving a correction value based on the conversion frequency, the wave of which is removed, in the wave removing process.

The method may further include a correction value deriving process for deriving a correction value based on the conversion frequency upon checking that amplitude of the conversion frequency is not greater than amplitude of the reference amplitude in the frequency comparison process.

The state data frequency in the data applying process may be obtained by selecting and applying one or more of a vehicle outdoor temperature and outdoor pressure.

The fuel injection amount adjusting process may include checking required or desired correction torque change inputted to the controller and adjusting a fuel injection amount according to the required or desired correction torque change.

The frequency deriving process may be repeatedly performed after the fuel injection amount adjusting process is performed.

The method may further include a data applying process for applying a state data frequency of the vehicle, which is inputted to the controller, before the derivation frequency is converted into the conversion frequency in the frequency conversion process, wherein frequency conversion may be performed after the data applying process is performed.

The data applying process may include applying the state data frequency to the conversion frequency and then converting the state data frequency into the converting frequency when amplitude of the state data frequency is equal to or more than a predetermined range pre-inputted to the controller in the data applying process.

The frequency comparison process may include comparing the conversion frequency converted through the frequency conversion process with a reference frequency pre-inputted to the controller.

The method may further include a wave removing process for removing a wave of the conversion frequency using a filter by the controller upon checking that amplitude of the conversion frequency is greater than amplitude of the reference frequency in the frequency comparison process, wherein a correction value deriving process for deriving the correction value may be performed after the wave removing process is performed.

The wave removing process may use a bandstop filter.

A correction value deriving process for deriving a correction value may be performed upon checking the amplitude of the reference frequency is smaller than the amplitude of the conversion frequency in the frequency comparison process.

The method may further include a correction value deriving process for deriving a correction value based on the conversion frequency when the amplitude of the state data frequency is within a predetermined range pre-inputted to the controller in the data applying process.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
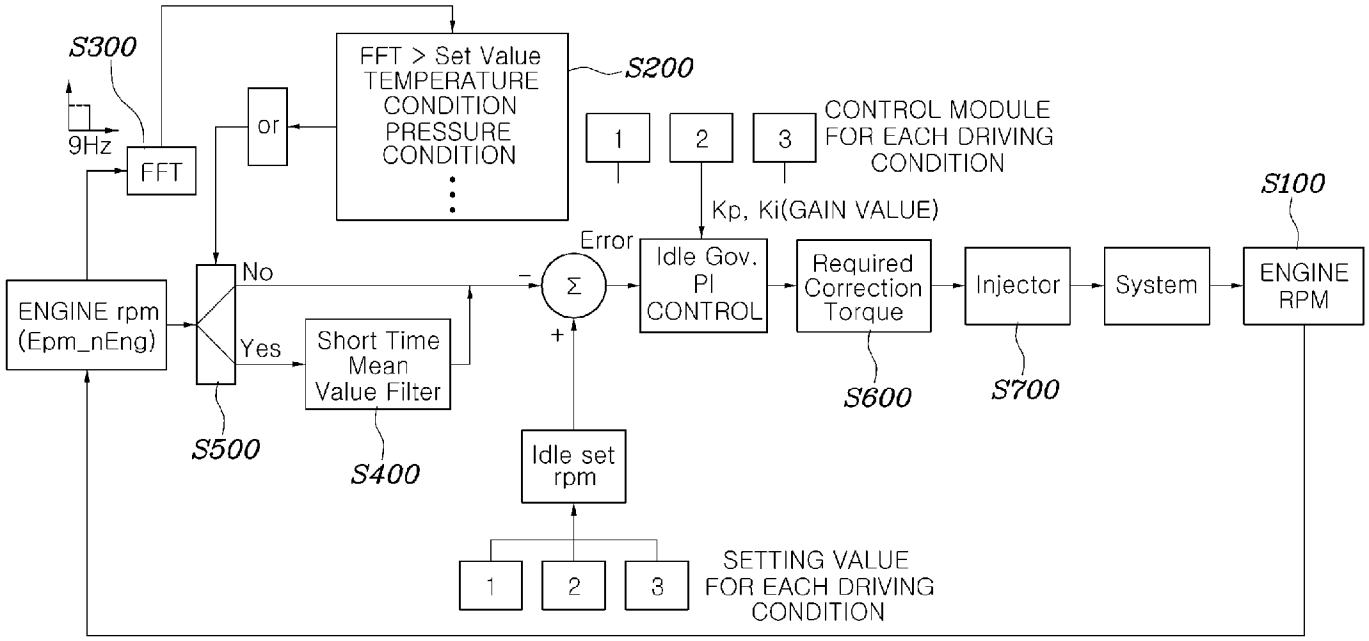
FIG. 1 is a diagram illustrating a method for controlling engine revolution per minute (RPM) according to one form of the present invention.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a method for controlling engine revolution per minute (RPM) according to the present disclosure will be described with reference to the accompanying drawings.

Figure 2:
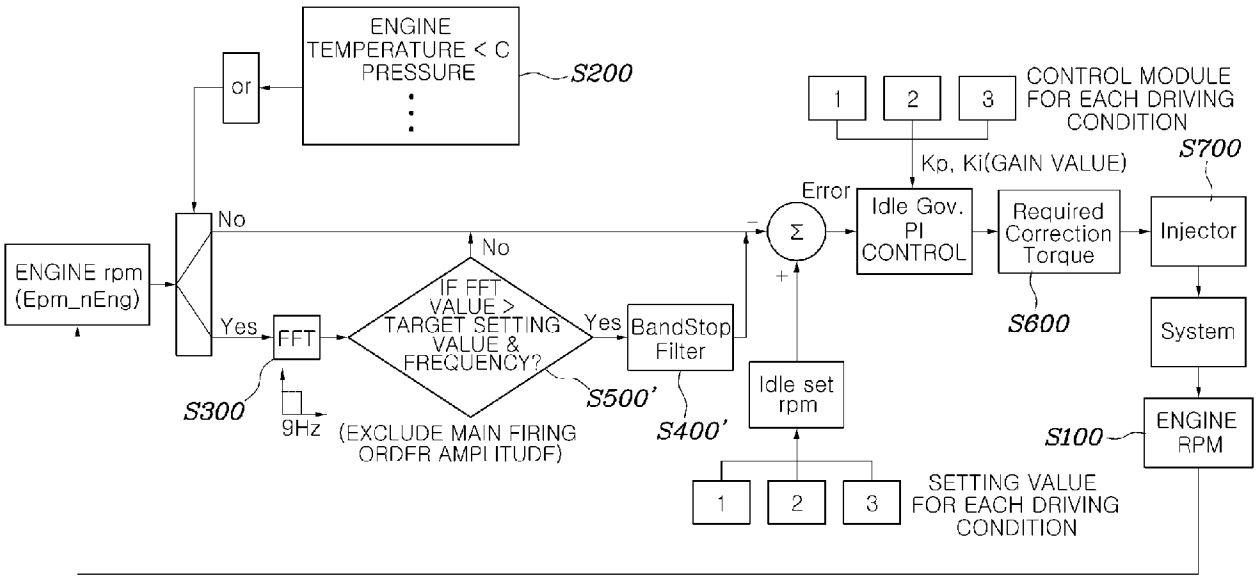
FIG. 2 is a diagram illustrating a method for controlling engine RPM according to another form of the present disclosure.
Figure 3:
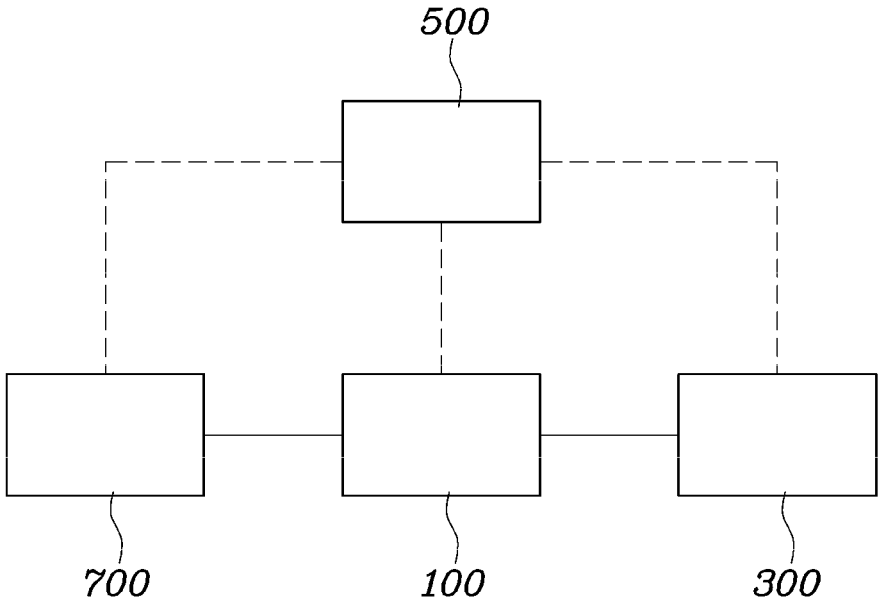
FIG. 3 is a diagram illustrating a structure for performing the controlling method of FIGS. 1 and 2.

Referring to FIGS. 1 to 3, the present disclosure may be applied, in particular, to a vehicle including a double clutch transmission (DCT) or double mass flywheel (DMF) external damper 300, in particular, in an idle state of an engine 100. In addition, one or more controllers 500 to be described below may be configured.

First, a method for controlling engine RPM will be described with reference to FIGS. 1 and 3. The method for controlling engine RPM may include a frequency deriving process S100; a frequency conversion process S300; a frequency comparison process S500; and a fuel injection amount adjusting process S700.

The frequency deriving process S100 is for deriving a frequency from change in engine RPM detected by a detector 700 by a controller 500 during driving of an engine 100, and the frequency conversion process S300 converts a derivation frequency derived in the frequency deriving process S100 into a conversion frequency via a predetermined conversion process by the controller 500.

In the frequency comparison process S500, an amplitude of the conversion frequency at which engine RPM is to be changed among conversion frequencies converted in the frequency conversion process S300 is compared with a reference frequency pre-inputted to the controller 500.

The fuel injection amount adjusting process S700 derives a correction value based on a result derived in the frequency comparison process S500, applies the derived correction value, and controls an injector by the controller 500 to adjust a fuel injection amount.

First, the controller 500 may perform the frequency deriving process S100 for deriving change in engine RPM detected by the detector 700 during driving of the engine 100 as a frequency. The frequency derived in the frequency deriving process S100 may be a frequency according to driving of the engine 100 or a frequency of engine PRM, which is changed due to vehicle excitation when disturbance occurs due to load applied to an engine drive system. The derivation frequency derived in the frequency deriving process S100 may be converted into the conversion frequency by the controller 500 via the frequency conversion process S300. In the frequency conversion process S300, the derivation frequency may be converted into the conversion frequency using Fourier Transform, in particular, Fast Fourier Transform.

The derivation frequency has complex waveform and period, whereas the conversion frequency converted in the frequency conversion process S300 has a plurality of simple frequencies, and thus the controller 500 recognizes amplitude of the conversion frequency at which engine RPM is to be changed among conversion frequencies. Here, the expression "engine RPM is to be changed" may simply refer to "engine order". The engine order may refer to an occurrence number of times of a factor for generating of vibration in a stroke of intake-compression-combustion-exhaust of the engine 100 and may be, for example, 0.5, 1, 2, 4 . . . .

In this case, in order to apply data about external environment of a vehicle to control, the method for controlling engine RPM may further include a data applying process S200 for applying a state data frequency of the vehicle, which is inputted to the controller 500, in the frequency comparison process S500. The state data frequency may be detected by a general detector 700 that detects a state of the vehicle.

In addition, the state data frequency may be obtained by converting the data of current external environments in which the vehicle is driven, such as a vehicle outdoor temperature and outdoor pressure into a frequency, and one or more of such data items may be selected and applied. In particular, the data may be applied when the vehicle is driven in an environment at a very low temperature and may be set as if when a reference temperature is 0° C. or less, a reference pressure is 1 atm or less. That is, the external environments of the vehicle may be applied so as to inhibit or prevent vibration or noise from being generated due to disturbance that is generated in an engine drive system according to the external environments of the vehicle.

Accordingly, in the frequency comparison process S500, amplitude of the conversion frequency at which engine RPM is to be changed among conversion frequencies to which the state data frequency is applied is compared with amplitude of the reference frequency after the data applying process S200 for applying the state data frequency of the vehicle, which is inputted to the controller 500, is performed.

The method for controlling engine RPM may further include a wave removing process S400 for removing a wave of the conversion frequency using a filter by the controller 500 upon checking that the amplitude of the conversion frequency is greater than that of the reference frequency in the frequency comparison process S500. In the wave removing process S400, the wave of the conversion frequency may be removed using a short time mean value filter which may use $$y(\phi) = \frac{\text{order}}{2\pi} \int_{\phi - \frac{2\pi}{order}}^{\phi} x(\phi) \cdot d\phi.$$

The method for controlling engine RPM may further include a correction value deriving process S600 for deriving a correction value based on the conversion frequency, the wave of which is removed, in the wave removing process S400. The controller 500 may perform the fuel injection amount adjusting process S700 for applying the correction value derived in the correction value deriving process S600 and controlling an injector to adjust a fuel injection amount to converge on the reference frequency pre-inputted to the controller 500. Accordingly, conventionally generated vibration and noise may be significantly reduced or removed to improve user satisfaction, thereby enhancing a brand image.

On the other hand, upon checking that the amplitude of the conversion frequency is not greater than the amplitude of the reference frequency in the frequency comparison process S500, the correction value deriving process S600 for deriving the correction value based on the conversion frequency may be performed without separately filtering a frequency, and then the fuel injection amount adjusting process S700 may be performed.

In the fuel injection amount adjusting process S700, a required or desired correction torque change inputted to the controller 500 may be checked and a fuel injection amount may be adjusted according to the required or desired correction torque change.

In addition, a setting value for each driving condition, pre-inputted to the controller 500, and a control module for each driving condition may be applied to control so as to control the fuel injection amount. This is pre-known, and thus a detailed description thereof will not be given in the specification. In addition, engine RPM may be controlled to converge on the reference frequency pre-input to the controller 500 by repeatedly performing the frequency deriving process S100 after the fuel injection amount adjusting process S700 is performed.

A method for controlling engine RPM according to another exemplary form of the present disclosure will be described with reference to FIGS. 2 and 3. The method for controlling engine RPM may include: the frequency deriving process S100 for deriving change in engine RPM detected by the detector 700 by the controller 500 during driving of the engine 100 as a frequency; the frequency conversion process S300 for converting the derivation frequency derived in the frequency deriving process S100 into a conversion frequency via a predetermined conversion process by the controller 500; a frequency comparison process S500' for comparing amplitude of the conversion frequency at which engine RPM is to be changed among conversion frequencies converted in the frequency conversion process S300 and a reference frequency pre-inputted to the controller 500; and the fuel injection amount adjusting process S700 for deriving a correction value based on a result derived in the frequency comparison process S500', applying the derived correction value, and controlling an injector by the controller 500 to adjust a fuel injection amount.

First, the controller 500 may perform the frequency deriving process S100 for deriving change in engine RPM detected by the detector 700 during driving of the engine 100 as a frequency. The frequency derived in the frequency deriving process S100 may be a frequency according to driving of the engine 100 or a frequency of engine PRM, which is changed due to vehicle excitation when disturbance occurs due to load applied to an engine drive system. The derivation frequency derived in the frequency deriving process S100 may be converted into the conversion frequency by the controller 500 via the frequency conversion process S300. In the frequency conversion process S300, the derivation frequency may be converted into the conversion frequency using Fourier Transform, in particular, Fast Fourier Transform.

In this case, in order to apply data about external environment of a vehicle to control, the method for controlling engine RPM may further include the data applying process S200 for applying a state data frequency of the vehicle, input to the controller 500 before the derivation frequency is converted into the conversion frequency, in the frequency conversion process S300. That is, with regard to the frequency conversion process S300, the frequency conversion process S300 for converting the derivation frequency into the conversion frequency may be performed after the data applying process S200 for applying the state data frequency of the vehicle, input to the controller 500, is performed.

The state data frequency may be detected by a general detector 700 that detects a state of the vehicle. In addition, the state data frequency may be obtained by converting the data of current external environments in which the vehicle is driven, such as a vehicle outdoor temperature and outdoor pressure into a frequency, and one or more of such data items may be selected and applied. In particular, the data may be applied when the vehicle is driven in an environment at a very low temperature and may be set as if when a reference temperature is 0° C. or less, a reference pressure is 1 atm or less. That is, the external environments of the vehicle may be applied so as to inhibit or prevent noise or vibration from being generated due to disturbance that is generated in an engine drive system according to the external environments of the vehicle.

In the data applying process S200, when the amplitude of the state data frequency is within a predetermined range pre-inputted to the controller 500, the correction value deriving process S600 for deriving the correction value based on the conversion frequency may be performed and then the fuel injection amount adjusting process S700 may be performed based on the derived correction value.

On the other hand, in the data applying process S200, when the amplitude of the state data frequency is equal to or greater than a predetermined range pre-input to the controller 500, the state data frequency may be applied to the conversion frequency and then converted into the conversion frequency. Then the frequency comparison process S500' may be performed, and in the frequency comparison process S500', the state data frequency is applied, and then the conversion frequency converted via the frequency conversion process S300 may be compared with a reference frequency pre-input to the controller 500. In this case, main firing order amplitude may be excluded during the comparison.

The method for controlling engine RPM may further include a wave removing process S400' for removing a wave of the conversion frequency using a filter by the controller 500 upon checking that the amplitude of the conversion frequency is greater than the amplitude of the reference frequency in the frequency comparison process S500'. In the wave removing process S400', a frequency of a region outside the reference frequency may be removed using a bandstop filter. For example, the band may be 7 to 11 Hz. The correction value deriving process S600 for deriving the correction value may be performed after the wave removing process S400' is performed, and then the controller 500 may perform the fuel injection amount adjusting process S700 to adjust a fuel injection amount and control the fuel injection amount so as to converge on the reference frequency. Accordingly, conventionally generated vibration and noise may be significantly reduced or removed to improve users' pleasure, thereby enhancing a brand image.

Upon checking that the amplitude of the reference frequency is smaller than the amplitude of the conversion frequency in the frequency comparison process S500', the correction value deriving process S600 for deriving the correction value based on the conversion frequency may be performed without separately filtering a frequency, and then the fuel injection amount adjusting process S700 may be performed.

In the fuel injection amount adjusting process S700, a required or desired correction torque change input to the controller 500 may be checked and a fuel injection amount may be adjusted according to the required or desired correction torque change.

In addition, a setting value for each driving condition, which is pre-inputted to the controller 500, and a control module for each driving condition may be applied to control so as to control the fuel injection amount. This is pre-known, and thus a detailed description thereof will not be given in the specification. In addition, engine RPM may be controlled to converge on the reference frequency pre-input to the controller 500 by repeatedly performing the frequency deriving process S100 after the fuel injection amount adjusting process S700 is performed.

According to the present disclosure, a method for controlling engine RPM may differently control a fuel injection amount according to whether an engine drive system resonates and may control the engine RPM using a frequency filtered by excluding resonance as an input signal when resonance occurs in the engine drive system so as to shorten or eliminate a period for interconnecting the fuel injection amount with the engine RPM, thereby a vicious cycle of resonance of the drive system. Accordingly, it is advantageous to overcome change in engine fuel amount to stabilize engine RPM and to remove vibration and noise. In addition, a short time mean value filter used for control may rapidly react to rapid change of a time domain signal so as to perform more accurate and quick control.

Although the present disclosure has been shown and described with respect to specific exemplary forms, it will be obvious to those skilled in the art that the present disclosure may be variously modified and altered without departing from the spirit and scope of the present disclosure.

What is claimed is:

1. A method for controlling engine revolution per minute (RPM), the method comprising:

a frequency deriving process, by a controller, for deriving frequency from change in engine RPM detected by a detector during driving of an engine;

a frequency conversion process for converting a derivation frequency derived in the frequency deriving process into a conversion frequency via a predetermined conversion process by the controller;

a frequency comparison process for comparing an amplitude of a reference frequency pre-inputted to the controller with an amplitude of the conversion frequency at which engine RPM is to be changed among conversion frequencies converted in the frequency conversion process; and a fuel injection amount adjusting process for deriving a correction value based on a result derived in the frequency comparison process, for applying the derived correction value, and for controlling an injector by the controller to adjust a fuel injection amount, wherein the frequency comparison process further comprises a data applying process for applying a state data frequency of a vehicle which is inputted to the controller, and a wave removing process for removing a wave of the conversion frequency using a filter by the controller upon checking that the amplitude of the conversion frequency is greater than the amplitude of the reference frequency.

2. The method of claim 1, wherein the frequency conversion process includes converting the derivation frequency into the conversion frequency using Fourier Transform.

3. The method of claim 1, wherein the frequency conversion process is applied in an idle state of the engine.

4. The method of claim 1, wherein the frequency comparison process includes comparing the amplitude of the reference frequency with the amplitude of the conversion frequency at which engine RPM is to be changed among the conversion frequencies to which the state data frequency is applied.

5. The method of claim 1, wherein the wave removing process includes removing the wave of the conversion frequency using a short time mean value filter.

6. The method of claim 1, wherein the wave removing process includes a correction value deriving process for deriving a correction value based on the conversion frequency from which the wave is removed.

7. The method of claim 1, further comprising a correction value deriving process for deriving a correction value based on the conversion frequency upon checking that the amplitude of the conversion frequency is not greater than the amplitude of the reference frequency in the frequency comparison process.

8. The method of claim 1, wherein the state data frequency in the data applying process is obtained by selecting and applying at least one of an outdoor temperature or an outdoor pressure of the vehicle.

9. The method of claim 1, wherein the fuel injection amount adjusting process includes checking a required correction torque change inputted to the controller and adjusting a fuel injection amount according to the required correction torque change.

10. The method of claim 1, wherein the frequency deriving process is repeatedly performed after the fuel injection amount adjusting process is performed.

11. The method of claim 1, wherein in the data applying process, the state data frequency of the vehicle is inputted to the controller before the derivation frequency is converted into the conversion frequency, and wherein frequency conversion is performed after the data applying process is performed.

12. The method of claim 11, wherein the data applying process includes applying the state data frequency to the conversion frequency and then converting the state data frequency into the converting frequency when an amplitude of the state data frequency is equal to or more than a predetermined range which is pre-inputted to the controller in the data applying process.

13. The method of claim 12, wherein the frequency comparison process includes comparing the conversion frequency converted through the frequency conversion process with the reference frequency pre-inputted to the controller.

14. The method of claim 13, wherein a correction value deriving process for deriving a correction value is performed after the wave removing process is performed.

15. The method of claim 14, wherein the wave removing process uses a bandstop filter.

16. The method of claim 14, wherein the correction value deriving process is performed upon checking the amplitude of the reference frequency is smaller than the amplitude of the conversion frequency.

17. The method of claim 11, further comprising a correction value deriving process for deriving a correction value based on the conversion frequency when an amplitude of the state data frequency is within a predetermined range pre-inputted to the controller in the data applying process.

* * * * *